US007107785B2

(12) United States Patent
Bärmann et al.

(10) Patent No.: US 7,107,785 B2
(45) Date of Patent: Sep. 19, 2006

(54) REFRIGERATOR WITH COOLING AIR CIRCULATION

(75) Inventors: Dieter-Jochen Bärmann, Hersbruck (DE); Hans-Kersten Hrubesch, Bruckmühl (DE); Ernst Stickel, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/801,958

(22) Filed: Mar. 15, 2004

(65) Prior Publication Data

US 2004/0255607 A1 Dec. 23, 2004

Related U.S. Application Data

(63) Continuation of application No. PCT/EP02/10209, filed on Sep. 11, 2002.

(30) Foreign Application Priority Data

Sep. 13, 2001 (DE) ..... 101 45 141

(51) Int. Cl.
*F25D 17/04* (2006.01)

(52) U.S. Cl. ..... 62/404; 62/407

(58) Field of Classification Search ..... 62/407, 62/404, 256, 414, 382, 405, 412, 441, 417, 62/465; 312/400–408
See application file for complete search history.

(56) References Cited

U.S. PATENT DOCUMENTS

| | | | | |
|---|---|---|---|---|
| 3,169,383 | A * | 2/1965 | Morton et al. | 62/414 |
| 3,707,317 | A | 12/1972 | Dawley et al. | |
| 3,982,801 | A | 9/1976 | Heidorn et al. | |
| 4,190,305 | A * | 2/1980 | Knight et al. | 312/406 |
| 4,736,997 | A * | 4/1988 | Besore et al. | 312/236 |
| 5,199,778 | A * | 4/1993 | Aoki et al. | 312/408 |
| 5,549,379 | A * | 8/1996 | Jun et al. | 312/408 |
| 5,564,809 | A * | 10/1996 | Kane et al. | 312/408 |
| 5,632,160 | A * | 5/1997 | Harangozo et al. | 62/408 |
| 5,813,741 | A * | 9/1998 | Fish et al. | 312/408 |
| 6,189,707 | B1 * | 2/2001 | Meyers et al. | 211/90.04 |

FOREIGN PATENT DOCUMENTS

| | | |
|---|---|---|
| FR | 1 407 947 | 9/1964 |
| JP | 05146348 A | 6/1993 |
| JP | 11241880 A | 9/1999 |
| JP | 11257830 A | 9/1999 |
| JP | 2000139636 A | 5/2000 |

* cited by examiner

*Primary Examiner*—Cheryl Tyler
*Assistant Examiner*—B. Clayton McCraw
(74) *Attorney, Agent, or Firm*—John T. Winburn; Russell W. Wamock; Craig J. Loest

(57) ABSTRACT

A refrigerating appliance includes a heat insulating housing and an inner chamber that is cooled by the circulation of cooling air. A hollow body extends in the inner chamber, defining a flow channel for the cooling air. Carriers for goods to be cooled are disposed in the inner chamber and are supported on the hollow body.

24 Claims, 7 Drawing Sheets

REFRIGERATOR WITH COOLING AIR CIRCULATION

CROSS-REFERENCE TO RELATED APPLICATION

This application is a continuation, under 35 U.S.C. § 120, of copending international application No. PCT/EP02/10209, filed Sep. 11, 2002, which designated the United States; this application also claims the priority, under 35 U.S.C. § 119, of German patent application No. 101 45 141.5, filed Sep. 13, 2001; the prior applications are herewith incorporated by reference in their entirety.

BACKGROUND OF THE INVENTION

Field of the Invention

The invention relates to a refrigerator having a thermally insulating housing and an internal area that is cooled by cooling air circulation and in which a hollow body extends that bounds a flow channel for the cooling air.

In conventional refrigerators of this type, the hollow body, which is also referred to as a multi-air-flow channel, is fitted centrally to the inner face of the refrigerator rear wall. This part, which can be seen by the user, is normally formed from an outer cover or sheath composed of a thermoplastic (SB, ABS) with an insulating part that is mounted in it in an interlocking and/or force-fitting manner. The sheath is attached to the rearward inner wall of the refrigerator by a screw connection and spacers on the foam side. Air channels are formed in the insulating part, in which cooling air is passed from the cold generator to the internal area of the refrigerator. The cooling air passes through openings in the insulating part and in the sheath into the internal area or cooling area.

Cooled item supports such as glass plates or gratings, on which the foods to be stored may be placed, are generally supported in conventional refrigerators on ribs that are integrally formed on the internal container of the refrigerator. It is also known for side depressions to be integrally formed in the walls of the internal container, in which connecting parts can be mounted, which are themselves used to support the cooled item supports.

Such a support has a number of disadvantages. Firstly, the ribs or depressions that are required to support the cooled item supports considerably complicate the molding of the internal container of the refrigerator that is normally produced by thermoforming a plastic panel. Specifically, to form the ribs or depressions, the mold must have so-called transverse slides that can be moved transversely with respect to a main forming direction (the depth direction of the internal container). These moving mold parts contribute considerably to the costs of the molds and increase the cost of their maintenance. Furthermore, their presence means that the original panel from which the internal container is formed is subjected to considerable stretching particularly in the areas that subsequently have to bear the load of the cooled item supports and of the cooled items located thereon so that the thickness of the original panel must be configured with a large safety margin to prevent the load from damaging the ribs or depressions during use of the refrigerator.

However, if damage nevertheless occurs, it is effectively uneconomic to repair such damage because the internal container of the refrigerator cannot be removed and replaced without, at the same time, damaging the insulating foam layer that surrounds it.

Furthermore, considerable effort is required by the user to clean such an internal container due to its uneven surfaces.

SUMMARY OF THE INVENTION

It is accordingly an object of the invention to provide a refrigerator with cooling air circulation that overcomes the hereinafore-mentioned disadvantages of the heretofore-known devices of this general type and that has an internal container formed by thermoforming using simple molds, and in which an original panel with thin walls may be used, and that can be cleaned easier by a user.

With the foregoing and other objects in view, there is provided, in accordance with the invention, a refrigerator, including a thermally insulating housing defining an internal area cooled by circulation of cooling air, a hollow body disposed in the internal area and bounding a flow channel for guiding the cooling air, and cooled item supports disposed in the internal area and supported on the hollow body.

Because, according to the invention, the cooled item supports that are disposed in the internal area of the refrigerator are supported on the hollow body, there is no need to form ribs, depressions, or other molding features for supporting the cooled item supports on the internal container of the refrigerator. Thus, it is possible to use simple, low-cost thermoforming molds. The absence of these molding features allows the use of original panels with thinner walls for forming the internal container so that material can be saved and costs can be reduced without this leading to any reduction in the robustness or life of the internal container.

The lack of molding features, furthermore, makes it possible to construct the walls of the internal container to be flat so that they can be cleaned quickly and effectively.

In accordance with another feature of the invention, the hollow body is, preferably, disposed such that it is in contact with a first wall, preferably, the rear wall, of the internal area. In such a configuration, the flow channel for the cooling air may be bounded, on one hand, by the hollow body and, on the other hand, by the first wall.

Connecting bodies such as screws, rivets, or the like may be used to attach the hollow body to the first wall and are, preferably, each connected to a stiffening part that is disposed behind the first wall, in particular, in the case of a refrigerator with an internal container, an outer wall, and a foam layer (which is disposed between the internal container and the outer wall) on that face of the internal container that faces the foam.

Alternatively or in conjunction with the connecting body, it is also possible to provide at least one projection (which is disposed on a second wall adjacent to the first wall) for holding the hollow body. In such a case, the second wall may not only be a side wall but also, and, preferably, a top or bottom of the internal container.

One preferred way to attach the hollow body is to use at least two projections, one on the second wall and one on a third wall opposite the second wall, with at least one of these projections having a wedge-shaped cross-section with a steep face touching the hollow body, and an oblique face facing away from the hollow body. These projections allow the hollow body to be attached by latching by, first of all, pushing one end of the hollow body over the oblique face of the projection against the first wall, and, finally, by latching it in behind the steep face, simultaneously making contact with it and with the first wall.

In accordance with a further feature of the invention, these projections are, preferably, each formed integrally with their walls and, in particular, they may expediently be formed in one operation during the thermoforming of the internal container.

In accordance with an added feature of the invention, the hollow body is provided with a large number of holders that are disposed along at least one vertical line and in which suspension hooks on the cooled item supports engage. Such a configuration allows different numbers of cooled item supports to be fitted at different levels corresponding to the position of the holders, depending on the requirements of the user of the refrigerator. This way of holding the cooled item supports, in principle, allows the heights of the cooled item supports to be adjusted in finer steps than in the case of the prior art.

In accordance with an additional feature of the invention, there is provided a at least one vertical rail for attachment of the cooled item supports to the hollow body and the rail has at least one toothed latching strip and an opposing bearing strip that is oriented in the other direction to the latching strip. In a complementary manner with respect thereto, each cooled item support has a lever section with an end that can be supported on the teeth of the latching strip, and with an end that can be supported on the opposing bearing strip. The weight of the cooled item support and of any cooled items that may be located on it results in a lever moment being applied to this lever section, pushing each of its ends against the latching strip or the opposing bearing strip. By pivoting a cooled item support against the torque, a user can disengage the lever section from the latching strip and the opposing bearing strip and can vary its height along the rail. Such a configuration allows the height of the cooled item support to be adjusted extremely finely in steps that each correspond to the distance between the teeth on the latching strip. This distance may be from a few millimeters up to a centimeter, preferably, about 5 mm.

In accordance with yet another feature of the invention, the rail is formed by the boundary walls of an elongated cavity, which is connected to the internal area of the refrigerator by a slot. The latching strip is, then, expediently disposed on a face of the cavity facing away from the internal area. Such a rail configuration may be produced not only with particularly low weight but, at the same time, also such that it is particularly stiff when loaded. In particular, such a rail allows guide functions for the lever section on the cooled item support to be produced in a simple manner.

To make it possible for a user to remove cooled item supports and to install them as well, the slot, preferably, has a broadened section that is configured for a lever section of a cooled item support such as this to pass through.

In accordance with yet a further feature of the invention, the broadened section is, preferably, located at the upper end or lower end of the slot.

If the broadened section is disposed at the upper end of the slot, then, if the lever section is at the same level as a supporting surface for the cooled item support, it is possible for a problem to arise in that the lever section can be inserted but, because the supporting surface is abutting against the top of the internal area, the cooled item support cannot be pivoted sufficiently to allow it to be lowered to a desired height without the lever section being blocked on a tooth of the latching section. To avoid such a situation, the lever section is, expediently, disposed at such a distance above the supporting surface for the cooled item support that the top of the internal container does not impede pivoting of the cooled item support, as is necessary to prevent the lever section from engaging with the latching strip.

In accordance with yet an added feature of the invention, the slot extends along the side of the rail that is oriented substantially at right angles to the latching strip and/or to the opposing bearing strip. Such a configuration has the advantage that it is possible, simply by pivoting the cooled item support, to detach the lever section from the rail at the side so that cooled item supports can be installed and removed at any desired level in the internal area of the refrigerator between already existing cooled item supports, without it being necessary to remove adjacent cooled item supports for this purpose.

In accordance with yet an additional feature of the invention, the rail is a profiled element with a T-shaped cross-section. With such a rail, the latching strip and the opposing bearing strip are, preferably, disposed on surfaces of the transverse bar of the T-shaped cross-section that face away from one another.

In accordance with again another feature of the invention, the cooled item supports are each equipped with a locking lever that prevents inadvertent release or pivoting of the cooled item support. Such a locking lever may, expediently, have a locking finger that can be moved between a locked position, in which it rests on the latching strip or on the opposing bearing strip, and a released position. In the locked position, together with the ends of the lever section, the locking finger forms a third contact point between the cooled item support and the rail, preventing any pivoting movement of the cooled item support with respect to the rail.

As an alternative thereto, the hollow body may also be provided with a locking bar for locking the position of the cooled item supports. Such a locking bar allows all of the cooled item supports to be locked or released in one action.

In a complementary manner to the locking bar, the cooled item supports are, preferably, each provided with a vertically oriented contour, in particular, a groove, which can be engaged with the locking bar to lock the pivoting movement of the cooled item supports.

In accordance with again a further feature of the invention, the hollow body is, preferably, an extruded profile, in particular, is composed of metal, for example, aluminum or a fiber-reinforced plastic. Such a profile can be produced using tools that are simpler and cheaper than those for thermoforming a complicated shape, in particular, when moldings that can move in two or more directions have to be thermoformed. Furthermore, the use of the extruded profile results in a further cost advantage if a profile with the same cross-section is used in different models of refrigerators, in which case, for models whose internal containers are of different heights, it is sufficient to cut the profile to a suitable length for matching purposes, and there is no need for any adaptation of the profile whatsoever for different internal container widths.

In accordance with again an added feature of the invention, the hollow body has air passage openings and actuator-controlled closure shutters are fitted to the air passage openings for selectively closing the air passage openings.

With the objects of the invention in view, there is also provided a refrigerator, including a thermally insulating housing defining an internal area cooled by circulation of cooling air, a hollow body disposed in the internal area and bounding a flow channel for guiding the cooling air, cooled item supports disposed in the internal area and supported on the hollow body, the cooled item supports having suspension hooks, the hollow body having a plurality of holders disposed along at least one vertical line for holding the cooled item supports, and the suspension hooks engaging the holders to hold the cooled item supports in the internal area.

With the objects of the invention in view, there is also provided a refrigerator, including a thermally insulating housing defining an internal area cooled by circulation of cooling air, a hollow body disposed in the internal area and bounding a flow channel for guiding the cooling air, cooled item supports disposed in the internal area and supported on the hollow body, the hollow body having an elongated cavity with boundary walls defining at least one vertical rail for holding the cooled item supports, the rail having at least one toothed latching strip and an opposing bearing strip oriented opposite the latching strip, and each of the cooled item supports having a lever section with an end selectively supported on the latching strip and an end selectively supported on the bearing strip.

Other features that are considered as characteristic for the invention are set forth in the appended claims.

Although the invention is illustrated and described herein as embodied in a refrigerator with cooling air circulation, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
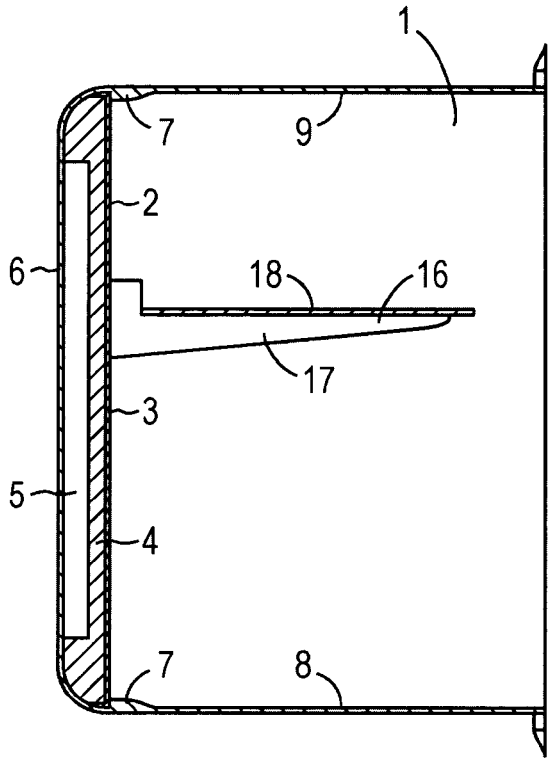
FIG. 1 is a cross-sectional view through an internal container of a refrigerator according to the invention with a hollow body mounted it and with a cooled item support that is suspended on the hollow body.

Referring now to the figures of the drawings in detail and first, particularly to FIG. 1 thereof, there is shown a cross-section through an internal container 1 for a refrigerator according to the present invention. In the complete refrigerator, the internal container 1 is surrounded by an outer wall and an insulating foam layer that is enclosed between the outer wall and the internal container; such a design is known and will, therefore, not be described in detail.

A hollow body 2, substantially formed from a fixed outer sheath 3 and a foam layer 4 that bounds a vertical flow channel 5 for the cooling air, extends over the entire height of the rear wall 6 of the internal container 1.

The hollow body 2 is held on the rear wall 6 by projections 7 that are formed integrally with the bottom 8 or the top 9 of the internal container 1.

Figure 2:
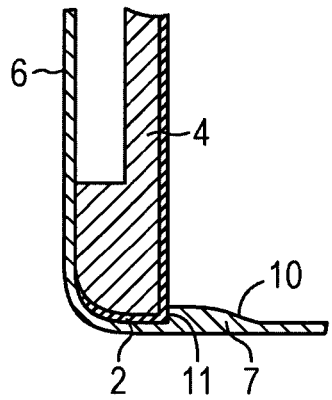
FIG. 2 is a fragmentary, enlarged cross-sectional view of a lower end of the hollow body of FIG. 1 and its attachment to the internal container.

As the enlarged detail in FIG. 2 shows, the projections 7 have a wedge-shaped cross-section with an inclined face 10 and a steep face 11, which is positioned such that the hollow body 2 is held in an interlocking manner between it and the rear wall 6.

The hollow body 2 may be installed, for example, by inserting the hollow body 2 into the internal container 1 in an inclined position, such that the upper end of the hollow body 2, first of all, touches the rear wall 6. Pushing the lower end of the hollow body 2 in the depth direction of the internal container 1 results in its upper end sliding up on the rear wall and engaging behind the projection 7 from the top 9; at the same time, the lower end of the hollow body 2 slides over the inclined face 10 of the lower projection 7, forcing the latter reversibly downwards, or reversibly bending the hollow body 2 itself, and, in the end, latching between the steep face 11 and the rear wall 6.

As is shown in FIG. 2, the fixed outer sheath 3 of the hollow body 2 in each case extends around its ends, thus preventing the foam layer 4 in the interior of the hollow body 2 from being permanently deformed when the hollow body 2 is pushed over one of the projections 7.

Figure 3:
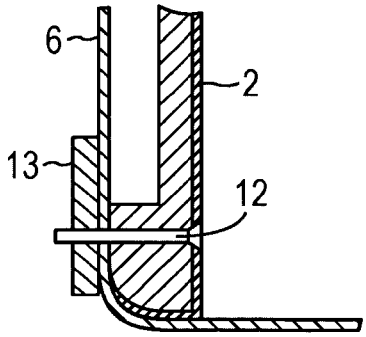
FIG. 3 is a fragmentary, enlarged cross-sectional view of an alternative embodiment of the lower end of the hollow body of FIG. 1 and of its attachment to the internal container.

As FIG. 3 shows, the hollow body 2 may alternatively also be mounted with the aid of a connecting body, such as a screw 12, which extends through a hole in the rear wall 6 and engages with a stiffening part 13, for example, a metal strip, which extends on the outer face of the internal container 1, between it and the surrounding insulating foam layer.

Figure 4:
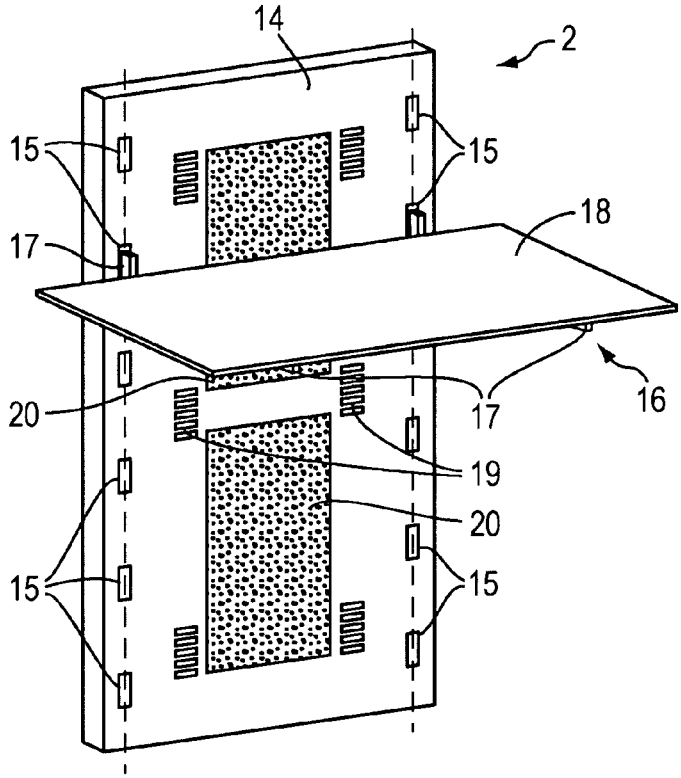
FIG. 4 is a perspective view of the hollow body of FIG. 1 with a cooled item support fitted thereto.

FIG. 4 shows a perspective view of the hollow body 2. Elongated holes 15, which are intended for cooled item supports 16 to be hooked therein, one of which is shown by way of example in FIG. 4, are formed at regular intervals along two vertical lines on the front face 14 of the hollow body 2. The cooled item support 16, which is illustrated schematically in a simplified form, is formed from two supporting arms 17 configured to bear loads, for example, cut from steel sheet with an appropriate material thickness, each of which engages with a non-illustrated hook in one of the holes 15, and a supporting plate 18 that is placed on the supporting arms 17 and is composed, for example, of safety glass.

Figure 5:
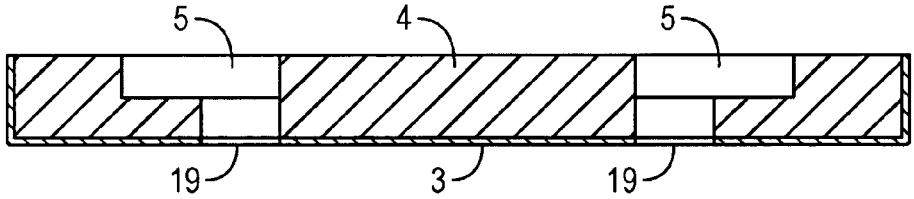
FIG. 5 is a horizontal cross-sectional view through the hollow body of FIG. 4.

Slots 19 that are disposed at different levels, in the present case run horizontally and are used as air outlet openings are also formed on the front face 14 of the hollow body 2 and, as is shown in the horizontal cross-section in FIG. 5, communicate with two vertical cooling air channels 5 that extend along the rear face of the hollow body 2 and are bounded on the one hand by its foam layer 4 and on the other hand by the rear wall 6 of the internal container.

Two large-area cutouts 20 on the front face 14 of the hollow body are covered with a transparent material, behind which is disposed a lighting device for illumination of the internal area.

Non-illustrated openings are provided in the rear wall 6 of the internal container 1 for the power supply for the lighting device to pass through and to supply cooling air to the channels 5. These openings may also be integrally formed during the manufacture of the internal container.

Figure 7:
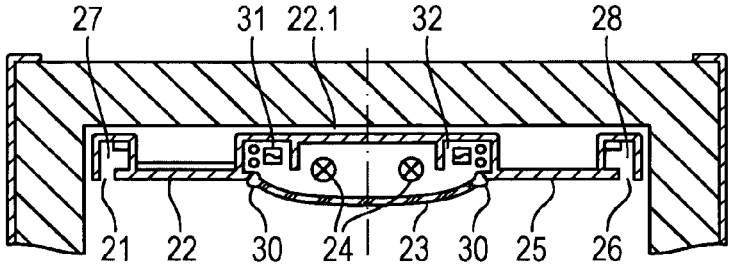
FIG. 7 is a horizontal cross-sectional view through a rearward area of the refrigerator of FIG. 6 with the internal container and hollow body.
Figure 6:
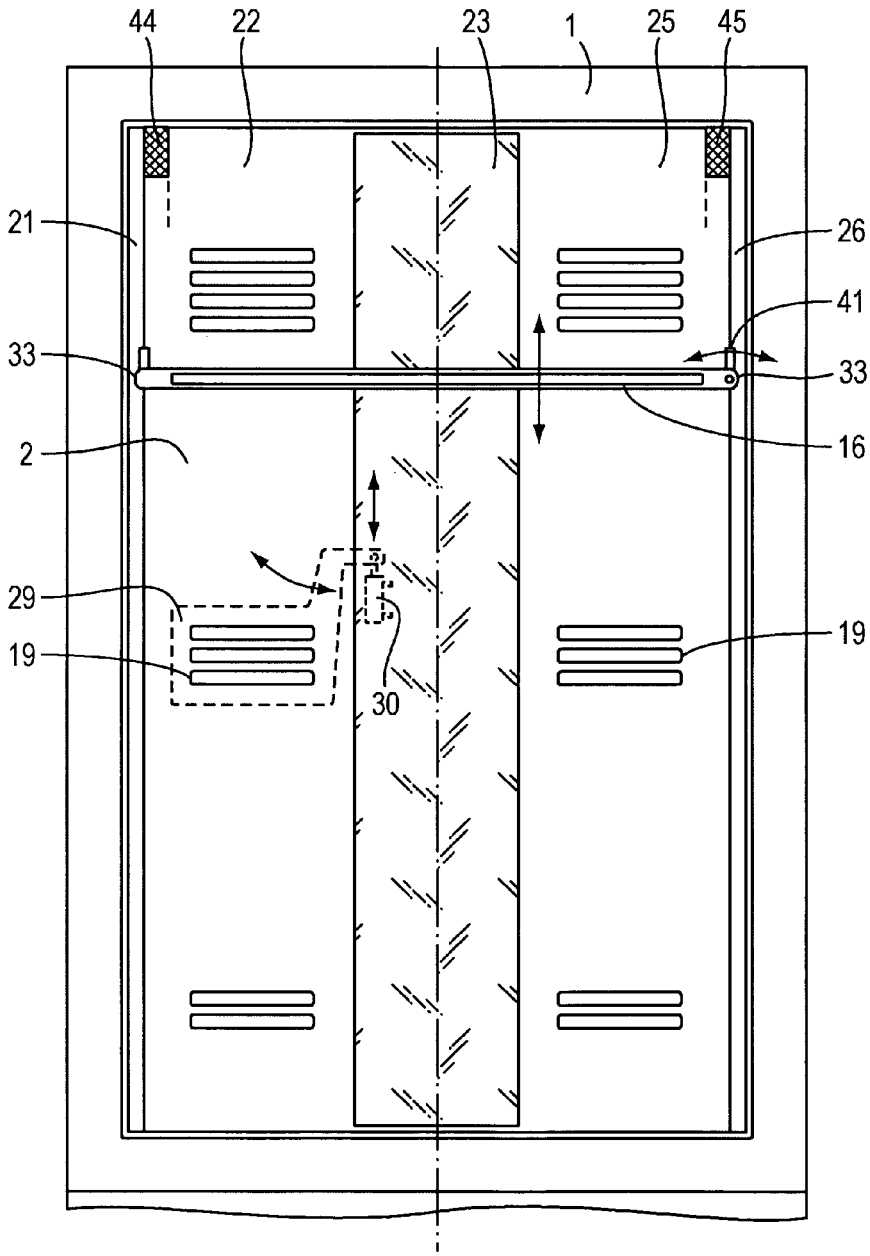
FIG. 6 is a front elevational view of a second embodiment of an internal container of a refrigerator according to the invention with a hollow body installed therein and with a cooled item support suspended on the hollow body.

FIG. 6 is a front view of the refrigerator, whose internal container 1, which is used to line its internal area, is provided with a hollow body 2, mounted on its rear wall, according to a second embodiment of the invention. In this embodiment, the hollow body 2 is an extruded profile composed of aluminum, which extends over the entire width of the rear wall and whose cross-section is shown in FIG. 7. The front view of the hollow body 2 is subdivided, from left to right in the figure, into a first vertical slot 21, a first flow channel section 22, a vertically running stepped-back section 22.1 that is covered by a transparent screen 23, for example, composed of acryl glass, behind which is a lighting device 24 fitted to illuminate the internal area, a second flow channel section 25 and a second vertically running slot 26.

As shown in the refinement in FIG. 4, slot-like outlet openings 19 are formed at different levels in the flow channel sections 22, 25, through which cooling air can emerge from the flow channel located behind them into the internal area.

As is illustrated by way of example in the form of a dashed outline in FIG. 6, the flow of cooling air through the slots 19 can be controlled by disposing a covering shutter 29 behind each group of outlet slots 19, which shutter 29 is opened or closed by an electrically driven actuator 30, for example, a motor-driven threaded spindle, as a function of the climatic conditions measured in the internal area. As is shown in the cross section in FIG. 7, the actuators 30 are accommodated in vertical channels 31, 32 in the hollow body 2, through which cable harnesses are also passed for the electrical supply to and control of the actuators 30 and of the lighting device 24.

The cooled item support 16, a front view of which is shown in FIG. 6, has two side supporting arms 33 with a supporting section 33.1 (see FIGS. 8 and 9) with an at least approximately C-shaped cross-section, whose free end sections, which have a concave cross-section, face one another and hold a supporting surface composed of glass between them. Supporting sections 33.2 (see FIGS. 8 and 9) are provided in the rearward area of the supporting arms 33 and engage through the slots 21, 26 in vertically elongated cavities 27, 28 that are located behind them and are in the form of holders, and whose boundary walls are used as guide elements for vertically adjustable suspension of the cooled item supports. The way in which the supporting arms 33 are suspended in these cavities 27, 28 is illustrated in detail in FIGS. 8 and 9.

Figure 8:
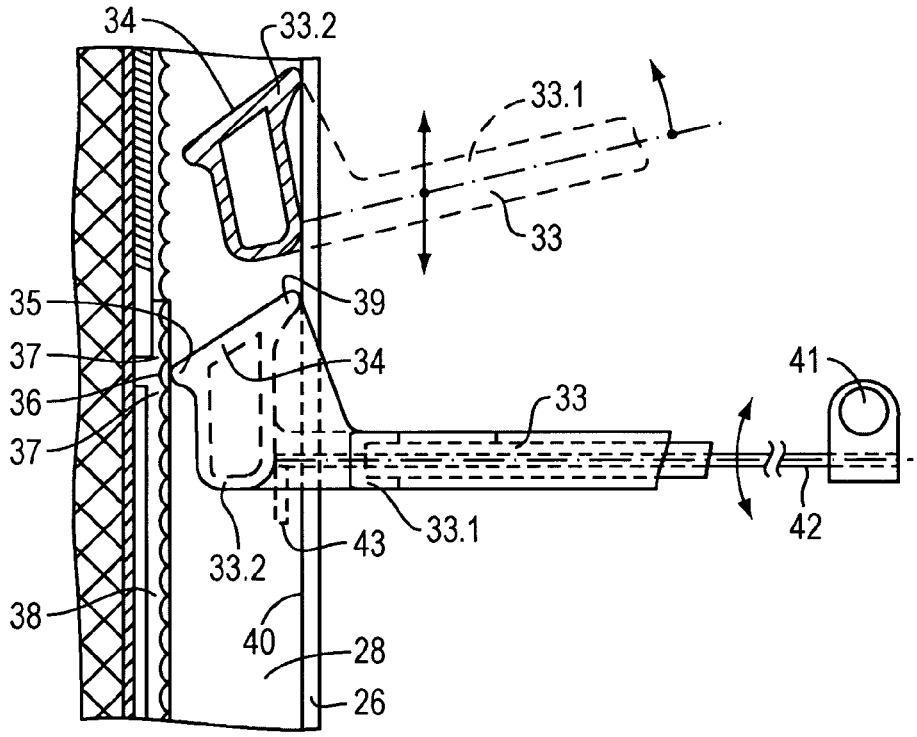
FIG. 8 is a fragmentary, enlarged, cross-sectional view of a side of the cooled item support and of its suspension on the hollow body of FIG. 6.

FIG. 8 shows a side view of a supporting arm 33, on one hand, in the form of solid lines, horizontally oriented, in a position anchored in the cavity 28, and, on the other hand, in the form of dashed lines, in an unanchored position, pivoted with respect to the horizontal.

The supporting section 33.2 (which engages in the cavity 28) of the supporting arm 33 is lengthened upwards beyond the plane of the glass plate and is fitted with a lever section 34 that extends obliquely through the cavity 28 and, in its anchored position, engages by a first end 35 in a tooth intermediate space 36 between teeth 37 on a latching strip 38, which extends along a surface of the cavity 28 facing the rear wall 6 of the internal container 1. A second end 39 rests on an opposing bearing strip 40, which forms an inner face of the cavity 28, facing the internal area and adjacent to the slot 26. The weight of the cooled item support and of any cooled items that may be located on it exerts a torque in the clockwise direction (with respect to FIG. 8) on the lever section 34, in each case pushing the ends 35, 39 of the lever section 34 against the respective surfaces 38, 40 facing them, and preventing the end 35 from being able to move out of the tooth intermediate space 36. The end 35 cannot be removed from the tooth intermediate space 36 unless a user lifts the front end of the cooled item support so that it is moved to the position illustrated by the dashed lines. In such an orientation, the cooled item support can be moved freely in the vertical direction and can be moved to any desired height that corresponds to a space 36 between teeth. Because the distance between the teeth 37 of the latching strip 38 may be quite small, in the order of a few millimeters, the configuration allows the height of a cooled item support to be matched considerably more accurately to the respective user requirement than is possible, for example, with conventional configurations having ribs, which are formed on the side wall of the internal container, for supporting the cooled item support.

It is important to prevent the cooled item support from being pivoted upwards inadvertently so that it cannot slide out, for example, in the loaded state, if a user accidentally knocks it from underneath. For such a purpose, the left-hand supporting arm 33 in FIG. 6 is equipped with a locking lever, whose operating section 41 can be seen in the front view in FIG. 6. The operating section 41 is connected to a locking finger 43 by a rod 42 (see FIG. 8) that is parallel to the supporting arm 33 and is guided within it, and the locking finger 43 can be pivoted between a position in which it has no effect and a locked position, by pivoting the operating section 41. FIG. 8 shows the position in which the locking finger 43 has no effect and in which it is oriented vertically downwards and can be moved out of the cavity 28 through the slot 26 when the cooled item support is pivoted to the position shown by the dashed lines. In its locked position, the locking finger 43 is oriented horizontally, and its free end rests on the opposing bearing strip 40, thus preventing the cooled item support from being pivoted.

To allow cooled item supports to be removed or to be hooked in additionally depending on the user's requirement, the two slots 21, 26 have respective broadened sections 44, 45 (see FIG. 6) at their upper ends, whose sizes are such that the lever sections 34 of the right-hand and left-hand supporting arms 33 of a cooled item support can be moved through freely. Because, as is shown in FIG. 8, the two ends 35, 39 of the lever section 34 are located above the mounting level of the cooled item support as defined by the supporting arms 33, it is possible to pivot the cooled item support sufficiently that it can be moved downwards to a desired height after insertion of the lever sections 34 of the two supporting arms into the cavities 27 and 28, without the end 35 being stuck on a tooth 37 of the latching strip 38 in the process.

Figure 9:
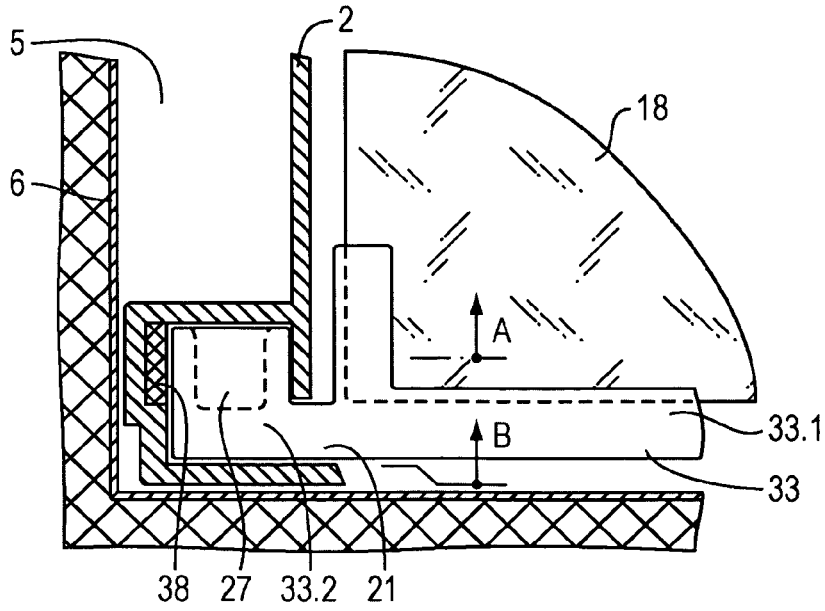
FIG. 9 is a fragmentary, enlarged, cross-sectional view from above the cooled item support and the hollow body of FIG. 8.

FIG. 9 shows a plan view of the cavity 27, which is a mirror image of the cavity 28. FIG. 9 shows that, the latching strip 38 is in the form of a part that is separate from the rest of the hollow body 2 and is mounted in the cavity 27 retrospectively.

As can easily be seen, as an alternative to the refinement illustrated in FIG. 8, it would also be possible to fit the lever sections 34 substantially at the same level as the supporting arms 33, or underneath them, while maintaining the inclined position between the ends 34, 39 of the lever sections 34. Fitting out of the plane of the supporting arms has the advantage that effective locking is possible with the aid of a locking finger, such as the locking finger 43, whose locked position is substantially at the same height as the supporting arms 33. If a lever section were to be used underneath the plane of the supporting arms 33, a locking finger, in order to be effective, would have to act in its locked position on the latching strip or on the outer face of the hollow body opposite the opposing bearing strip 40. A broadened section of the slots 21, 26 would, then, have to be provided at the lower end of each of the slots in order to hook the cooled item supports in, and to unhook them.

Figure 10:
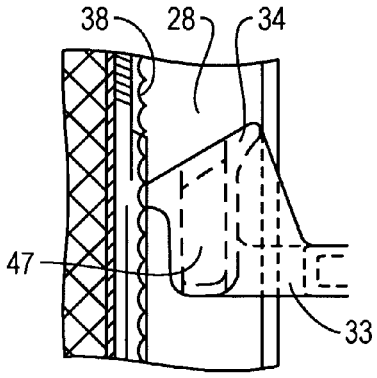
FIG. 10 is a fragmentary, enlarged, cross-sectional view of a side of an alternative embodiment of the cooled item support and of its suspension on the hollow body of FIG. 8.
Figure 11:
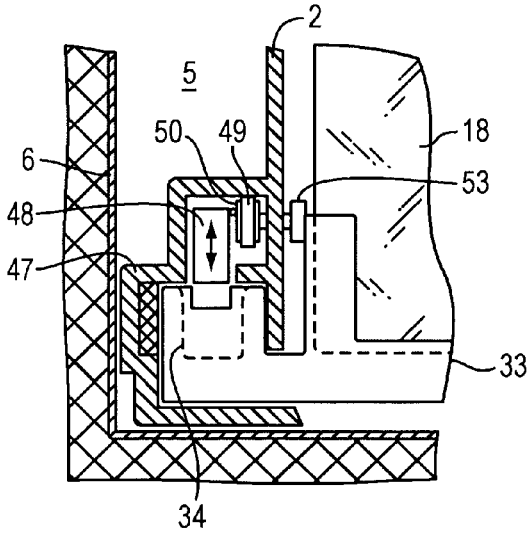
FIG. 11 is a fragmentary, enlarged, cross-sectional view from above the cooled item support and the hollow body of FIG. 10.
Figure 12:
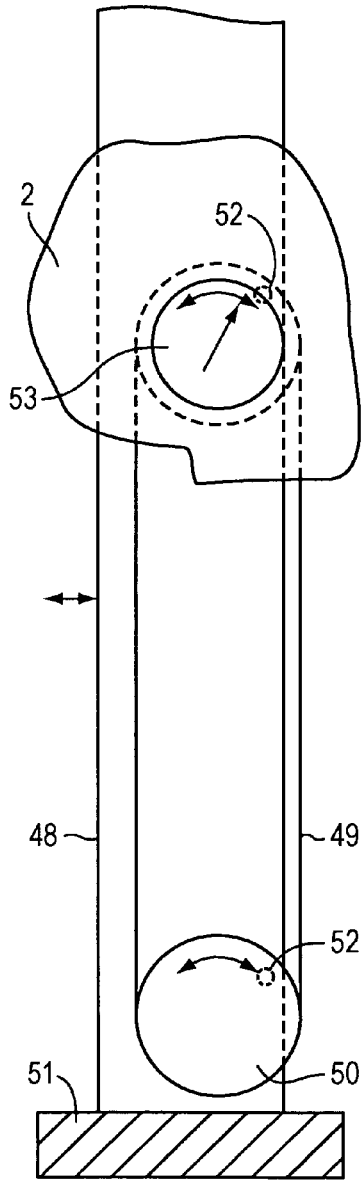
FIG. 12 is a fragmentary, enlarged, partially cross-sectional and partially hidden view of the locking bar of FIG. 11 and a method of operating the locking bar.

FIGS. 10 to 12 illustrate another possible way to protect the cooled item supports 16 against inadvertent pivoting. In the case of the end section of the supporting arm 33 as shown in FIG. 10, which engages in the cavity 28, a groove 47 that is indicated by a dashed line and faces away from the viewer extends exactly vertically when the lever section 34 is correctly engaged on the latching strip 38, that is to say, when the end 35 engages in a space between the teeth of the latching strip 38. A locking bar 48 in the form of a rod extending substantially over the entire length of the cavity .28 on a side wall of the cavity 28 opposite the groove 47 can be moved between a position in which it has no effect, as shown in FIG. 11, and a locked position, in which the locking bar 48 engages in the grooves 47 in all of the supporting arms that engage in the cavity 28.

A mechanism having two wheels 50, which are coupled by a belt 49 or in some other suitable manner, as shown schematically in FIG. 12, may be used to move the locking bar 48 between the position in which it has no effect and the locked position. FIG. 12 shows the locking bar 48 in the position in which it has no effect, standing on the bottom 51 of the cavity 28. The rod is connected to the wheels 50 through two eccentric pins 52 such that it can rotate; one of the wheels 50 is connected through an opening in the front face of the hollow body 2 to a control knob 53 in the internal area of the refrigerator. Rotation of the control knob 53 in the counter clockwise direction raises the locking bar 48 and pushes it to the left in the perspective shown in FIG. 12 so that it engages in the grooves 47 in the supporting arms 33. The locked position is reached as soon as the locking bar 48 comes to rest on the bottom 51 again.

If only one of the cooled item supports is not positioned correctly, so that its groove 47 is not exactly vertical, the locking bar 48 cannot engage in the locked position, and the control knob 53 returns to the illustrated position in which it has no effect on being released. This immediately warns a user when the action of hooking in the cooled item supports that is carried out is not secure.

Figure 13:
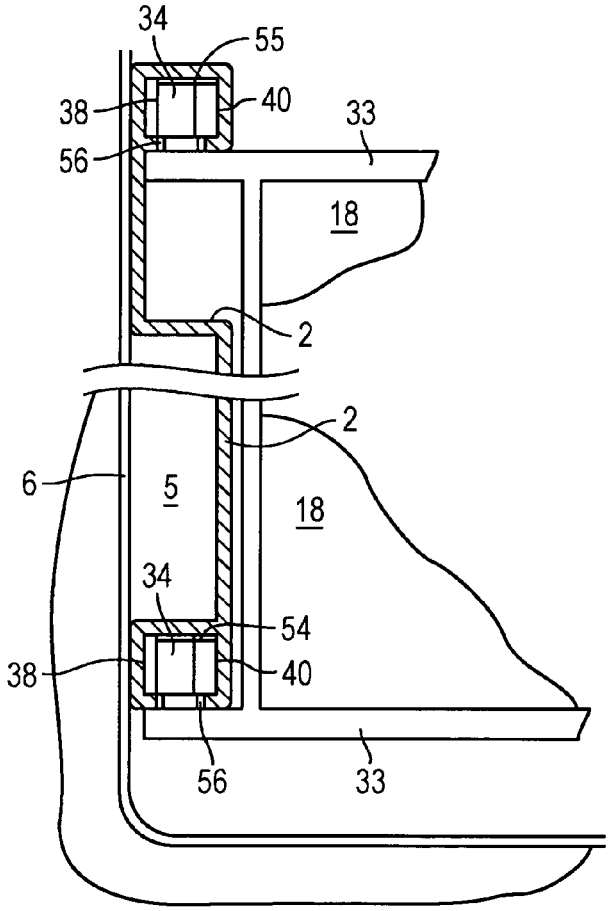
FIG. 13 is a fragmentary, enlarged, cross-sectional view from above another embodiment of the cooled item support and the hollow body according to the invention.

FIG. 13 shows a plan view of two rails for guiding and holding the lever section 34 of a supporting arm 33 according to a modified refinement. As in the case of FIGS. 8 and 9, the rails are in the form of an elongated vertical cavity 54, 55, with a latching strip 38 on a side facing the rear wall 6 of the refrigerator, and with an opposing bearing strip 40 on a side facing the internal area. A slot 56 extends over a side wall of the cavity 54, 55 that is oriented at right angles to the latching strip 38 and to the opposing bearing strip 40. The cavities 54, 55 are each disposed on the side edges of the hollow body 2. Their outlines are not approximately mirror images of the cavities 27, 28, but are exactly identical.

The lever section 34 of the supporting arm 33 that engages in the cavity 54 has a first end 35 that rests on a step (which is in the form of a sawtooth) on the latching strip 38 (in other words: it engages in a space between two teeth), and a second end 39, which rests on the opposing bearing strip 40. By pivoting the supporting arms 33 in the counter-clockwise direction, the lever sections 34 can be moved to a position in which they extend substantially vertically and can be pushed out of the cavities 54, 55 at the side (downwards in FIG. 13), after which it is possible to remove the entire cooled item support.

Figure 14:
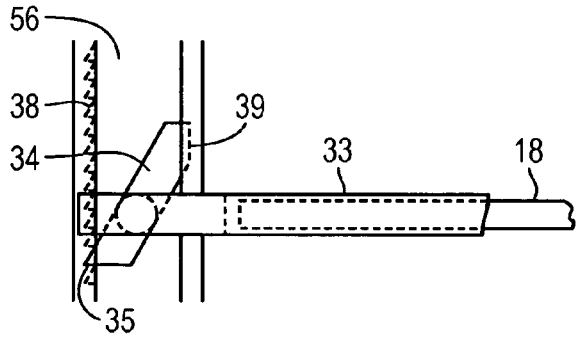
FIG. 14 is a fragmentary, enlarged, cross-sectional view of a side of the support and hollow body of FIG. 13.

Although not described specifically, it is, of course, also possible for the cooled item support of FIGS. 13 and 14 to be equipped with a locking lever as shown in FIGS. 6 and 8, or with the locking bar as described with reference to FIGS. 10 to 12.

Figure 15:
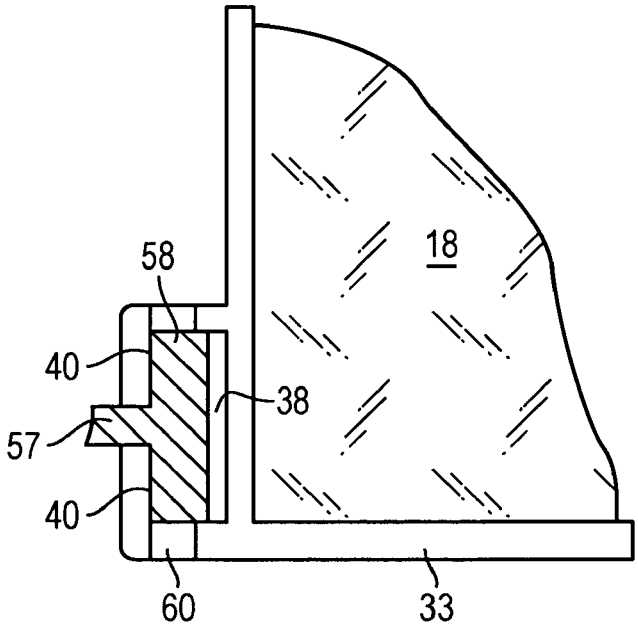
FIG. 15 is a fragmentary, enlarged, cross-sectional view from above a further embodiment of the cooled item support and the hollow body according to the invention.
Figure 16:
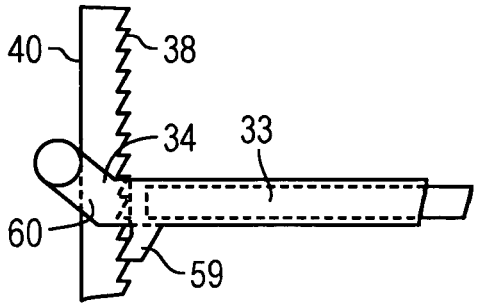
FIG. 16 is a fragmentary, enlarged, cross-sectional view of a side of the support and hollow body of FIG. 15.

FIGS. 15 and 16 show a further refinement of a rail 57 for suspension of cooled item supports and of a cooled item support matched thereto. The rail 57, which is, once again, formed integrally with the hollow body 2 as an extruded profile, has a T-shaped cross-section with the toothed latching strip 38 disposed on a surface of the transverse bar 58 of the T-shaped cross-section facing the internal area or the cooled item support 16. The opposing bearing strip extends on the rear face of the transverse support 59. In such a case, the lever section 34 is formed from a point 59 that projects downwards from the supporting arm 34 and engages in a space between the teeth of the latching strip 38, and two hooks 60, which are angled obliquely upwards, clasp the transverse support 58 and rest on its rear opposing bearing strip 40.

We claim:

1. A refrigerator, comprising:

a thermally insulating housing defining an internal area cooled by circulation of cooling air;

a hollow body disposed in said internal area and bounding a flow channel for guiding the cooling air;

cooled item supports disposed in said internal area and supported on said hollow body;

said internal area has a first wall;

said hollow body is disposed in contact with said first wall;

said internal area has a second wall adjacent said first wall; and at least one projection is disposed on said second wall and holds said hollow body in said internal area.

2. The refrigerator according to claim 1, wherein said first wall is a rear wall of said internal area.

3. The refrigerator according to claim 1, wherein said flow channel is bounded by said hollow body and said first wall.

4. The refrigerator according to claim 1, further comprising at least one connecting body holding said hollow body at said first wall.

5. The refrigerator according to claim 4, further comprising a stiffening part disposed behind said first wall, said connecting body connecting said hollow body to said stiffening part.

6. The refrigerator according to claim 1, wherein:

said internal area has a third wall opposite said second wall;

at least one second projection is disposed on said third wall; and at least one of said first and second projections has:

a wedge-shaped cross-section with a steep face touching said hollow body when said hollow body is fitted in said internal area; and an oblique face facing away from said hollow body when said hollow body is fitted in said internal area.

7. The refrigerator according to claim 6, where in each of said first and second projections is formed integrally with a respective one of said second and third walls on which said projection is disposed.

8. The refrigerator according to claim 1, wherein:

said cooled item supports have suspension hooks;

said hollow body has a plurality of holders disposed along at least one vertical line for holding said cooled item supports; and said suspension hooks engage said holders to hold said cooled item supports.

9. The refrigerator according to claim 1, wherein said cooled item supports have a locking lever for locking said cooled item supports with respect to said hollow body.

10. The refrigerator according to claim 1, wherein said hollow body has a locking bar for locking positions of said cooled item supports.

11. The refrigerator according to claim 10, wherein said cooled item supports each have a vertically oriented contour selectively engaged with said locking bar and preventing said cooled item supports from pivoting when engaged with said locking bar.

12. The refrigerator according to claim 1, wherein said hollow body is a profile selected from the group consisting of:

an extruded profile; and a shaped and non-cut profile of a material selected from the group consisting of metal and fiber-reinforced plastic.

13. The refrigerator according to claim 1, wherein:

said hollow body has air passage openings; and actuator-controlled closure shutters are fitted to said air passage openings for selectively closing said air passage openings.

14. A refrigerator, comprising:

a thermally insulating housing defining an internal area cooled by circulation of cooling air;

a hollow body disposed in rail internal area and bounding a flow channel for guiding the cooling air;

cooled item supports disposed in said internal area and supported in said hollow body;

at least one vertical rail disposed on the hollow body for holding said cooled item supports, said rail having at least one toothed latching strip, and an opposing bearing strip oriented opposite said latching strip; and a respective lever section on each one of said cooled item supports, each lever section having an end selectively supported on said latching strip, and an end selectively supported on said bearing strip.

15. The refrigerator according to claim 14, wherein:

said hollow body has an elongated cavity with boundary walls;

said boundary walls form said rail; and said elongated cavity has a slot connecting said elongated cavity to said internal area.

16. The refrigerator according to claim 15, wherein:

said cavity has a face facing away from said internal area; and said latching strip is disposed on said face.

17. The refrigerator according to claim 15, wherein:

said cavity has a face opposite said internal area; and said latching strip is disposed on said face.

18. The refrigerator according to claim 15, wherein said slot is broadened at one end thereof to allow introduction of said lever section.

19. The refrigerator according to claim 18, wherein:

each of said cooled item supports has a supporting surface; and said slot has an upper end and a lower end and is one of:

broadened at said upper end and said lever section is disposed above said supporting surface; and broadened at said lower end and said lever section is disposed underneath a supporting surface.

20. The refrigerator according to claim 15, wherein:

said rail has a face oriented at substantially at right angles to at least one of said latching strip and said bearing strip; and said slot extends along said face.

21. The refrigerator according to claim 14, wherein said rail is a profiled element with a T-shaped cross-section.

22. The refrigerator according to claim 21, wherein:

said T-shaped cross section has a transverse bar with surfaces facing away from one another; and said latching strip and said opposing bearing strip are disposed on said surfaces of said transverse bar.

23. The refrigerator according to claim 14, wherein:

said cooled item supports have a locking lever for locking said cooled item supports with respect to said hollow body; and said locking lever has a locking finger selectively moved between a locked position, in which said locking finger rests on one of said latching strip said opposing bearing strip, and a released position.

24. A refrigerator, comprising:

a thermally insulating housing defining an internal area cooled by circulation of cooling air;

a hollow body disposed in said internal area and bounding a flow channel for guiding the cooling air;

cooled item supports disposed in said internal area and supported on said hollow body;

said hollow body having an elongated cavity with boundary walls defining at least one vertical rail for holding said cooled item supports, said rail having:

at least one toothed latching strip; and an opposing bearing strip oriented opposite said latching strip; and each of said cooled item supports having a lever section with:

an end selectively supported on said latching strip; and an end selectively supported on said bearing strip.

* * * * *